US008336602B2

(12) United States Patent
Huellen et al.

(10) Patent No.: US 8,336,602 B2
(45) Date of Patent: Dec. 25, 2012

(54) CONTINUOUS CASTING INSTALLATION WITH A DEVICE FOR DETERMINING SOLIDIFICATION STATES OF CASTING STRAND AND ASSOCIATED METHOD

(75) Inventors: Ina Huellen, Duesseldorf (DE); Andreas Runge, Remscheid (DE); Holger Beyer-Steinhauer, Mettmann (DE); Markus Reifferscheid, Korschenbroich (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 0 days.

(21) Appl. No.: 12/735,282

(22) PCT Filed: Dec. 23, 2008

(86) PCT No.: PCT/EP2008/011069

§ 371 (c)(1), (2), (4) Date: Aug. 25, 2010

(87) PCT Pub. No.: WO2009/083231

PCT Pub. Date: Jul. 9, 2009

(65) Prior Publication Data

US 2010/0319873 A1 Dec. 23, 2010

(30) Foreign Application Priority Data

Dec. 28, 2007 (DE) ..... 10 2007 063 098
Mar. 15, 2008 (DE) ..... 10 2008 014 524

(51) Int. Cl.
*B22D 11/16* (2006.01)
*B22D 11/20* (2006.01)

(52) U.S. Cl. ..... 164/451; 164/454; 164/413; 164/154.8

(58) Field of Classification Search ..... 164/451, 164/452, 454, 484, 413, 151, 154.8
See application file for complete search history.

(56) References Cited

U.S. PATENT DOCUMENTS

| | | | |
|---|---|---|---|
| 4,056,140 | A | 11/1977 | Ives |
| 4,090,549 | A | 5/1978 | Ives |
| 4,211,273 | A | 7/1980 | Scheurecker |
| 4,256,169 | A | 3/1981 | Ives |
| 6,470,957 | B1 | 10/2002 | Ashburn |
| 6,615,903 | B2 | 9/2003 | Lingren |

(Continued)

FOREIGN PATENT DOCUMENTS

DE 10 2005 049 151 A1 4/2007

(Continued)

OTHER PUBLICATIONS

K. Moerwald et al., Roll load measurement on thin slab caster for liquid core detection, Ironmaking and Steelmaking, 1998, v. 25, No. 2, pp. 159-162.

*Primary Examiner* — Kevin P Kerns
(74) *Attorney, Agent, or Firm* — Abelman, Frayne & Schwab

(57) ABSTRACT

A continuous casting installation (20) including a strand guide having strand casting segments with rollers (2) for guiding a cast strand, wherein at least one of the strand casting segments (22, 23, 24, 25, 26, 27) is formed as a measurement segment, wherein there is provided at least one measurement point for direct or indirect determination of a force acting on one or several rollers (2), wherein further the at least one measurement point is provided on a support housing (30), preferably between the support and the segment frame of strand casting segment, and there is provided a data processing unit that based on data of the at least one measurement point determines the solidification states of the cast strand.

10 Claims, 4 Drawing Sheets

U.S. PATENT DOCUMENTS

| | | | |
|---|---|---|---|
| 2007/0251662 | A1 | 11/2007 | Weyer |
| 2008/0308251 | A1 | 12/2008 | Weyer |
| 2009/0301225 | A1 | 12/2009 | Girgensohn |

FOREIGN PATENT DOCUMENTS

| | | | |
|---|---|---|---|
| DE | 10 2006 016 375 | A1 | 10/2007 |
| EP | 0625388 | A1 | 11/1994 |
| EP | 1193007 | A1 | 3/2002 |

CONTINUOUS CASTING INSTALLATION WITH A DEVICE FOR DETERMINING SOLIDIFICATION STATES OF CASTING STRAND AND ASSOCIATED METHOD

TECHNICAL FIELD

The invention relates to a continuous casting installation with a device for determining solidification states of a cast strand and method thereof.

PRIOR ART

Continuous casting installations are known in the prior art since long ago. Such continuous casting installation for casting liquid metals have typically, downstream of the mold, a strand guide with strand guide segments for the cast strand. With continuous casting installations, the knowledge of the solidification length of the cast strand is particularly important. The solidification length or the point of complete solidification of the strand is a parameter for operating the continuous casting installation. The point of solidification or the solidification length corresponds to a solid component of the cast strand of 100%, which means that in the core of the cast strand, no liquid or doughy material is present. Further, the knowledge of the degree of solidification of the strand of less than 100% is of interest for strand guidance and strand cooling.

In the Prior Art, continuous casting installations are known in which the solidification length is determined by measuring the displaceable amount of the core fluid volume per unit of length and, based on the measurement variables, a model calculation is carried out for an instantaneous length of the liquid pool tip. Such continuous casting installation is disclosed in WO 2005/068109 A1.

EP 1 193 007 A1 discloses a method of determining the position of solidification in the cast strand, wherein the support segments are provided, and, for determination of the position of the solidification, in one of the segments, the strand pulling force of the drawing roller and/or the clamping force of hydraulic piston-cylinder units of the support segments are measured and, based on measurement variable, the region of the liquid pool tip is determined.

It is further known to carry out pyrometric measurement, captive bolt method, internal split determination, or, as above, force measurement on lifting cylinders for determining the strand solidification. These methods are, however, used only temporarily, wherein they are also used only locally.

Further, there exists a possibility of a pure mathematical determination of the position of the strand solidification which, however, requires an individual model for each installation and which must be validated by above discussed measurements. Also, softness can change from material to material, so that the model, if necessary, should be made material-dependent.

DISCLOSURE OF THE INVENTION OBJECT, SOLUTION, ADVANTAGES

It is an object of the present invention to provide a continuous casting installation with a device for determining solidification states of the cast strand and with which a reliable and continuous determination of the solidification states can be carried out.

According to the invention, the object is achieved with respect to the continuous casting installation, by a continuous casting installation including a device for determining solidification states of the cast strand, a strand guide having strand casting segments with rollers, wherein at least one of the strand casting segments is formed as a measurement segment, wherein there is provided at least one measurement point or several measurement points for direct or indirect determination of a force acting on one or several rollers, wherein further the at least one measurement point is provided on a support housing, preferably between the support and the segment frame of the strand casting segment, and there is provided a data processing unit that based on data of the at least one measurement point, determines the solidification state of the cast strand.

It is advantageous when the measurement point is provided on at least one support housing of a middle support or several middle supports. Thereby, the force applied by the strand to the roller can be reliably detected.

According to another embodiment, it is useful when the measurement point is provided on a support housing on the fixed side and/or the loose side of a segment. Thereby, advantageously, a non-uniform force distribution on the roller can be detected.

It is further advantageous when a plurality of measurement points connected with each other is provided within the strand guide. The connection can advantageously be effected with a data line or lines or without a cable. The connection can also be effected via the data processing unit. It is useful when the connection via the data processing unit results in a measuring system or systems.

Advantageously, the middle support is formed of simple or multiple times split rollers as measurement points or is provided with measurement points.

It is further advantageous when level differences are determined by the data processing unit by an analytical, statistical evaluation method, and a solidification state is derived therefrom.

It is useful when a determination of a solidification state is carried out by associating a solidification state with a characteristic measurement variable.

It is further useful when the characteristic measurement variable is a support deformation or deformation of a support element, such as a slot of the support.

It is also advantageous when a determination of a solidification state is carried out by associating a solidification state with scattering of a characteristic measurement variable.

It is further advantageous when scattering of the measurement variable is scattering of support deformation or scattering of deformation of a support element.

It is also advantageous when a measurement variable is evaluated by the data processing unit by fast Fourier analysis or another statistic evaluation method and, thereby instrumental influences on the measurement variable are determined.

The object with respect to the method is achieved with a method of determining solidification states a cast strand in a continuous casting installation with a strand guide having strand casting segments with rollers, wherein at least one of the strand casting segments is formed as a measurement segment, wherein there is provided at least one measurement point or several measurement points for direct or indirect determination of a force acting on one or several rollers, wherein further the at least one measurement point is provided on a support housing, preferably between the support and the segment frame of the strand casting segment, and which detects the force-representing variable, and there is provided a data processing unit that based on data of the at least one measurement point, determines solidification states of the cast strand.

It is useful when the measurement point is provided on at least one support housing of a middle support or supports. It is further useful when the measurement point is provided on the support housing on the fixed side and/or on the loose side of a roller. Also advantageously, a plurality of measurement points, which are connected with each other, are provided within the strand guide. Advantageously, the connection via the data processing unit results in a measurement system.

It is advantageous when the middle support is formed of simple or multiple times split rollers as measurement points.

It is further useful, according to the invention, when the data processing unit determines the level differences of the measurement variables by analytical, statistical evaluation method, and a solidification state is derived therefrom.

Still further, it is useful when a determination of a solidification state is carried out by associating a solidification state with a characteristic measurement variable. It is useful when the characteristic measurement variable is bearing force or bearing deformation. It is further advantageous when the determination of a solidification state is effected by associating a solidification state with scattering of a characteristic measurement variable. Advantageously, the scattering of a characteristic measurement variable is scattering of support force or support deformation.

It is likewise advantageous when a measurement variable is evaluated by the data processing unit by fast Fourier analysis or another statistic evaluation method and, thereby instrumental influences on the measurement variable are determined.

BRIEF DESCRIPTION OF THE DRAWINGS

Below the invention will be explained in detail based on an exemplary embodiment with reference to the drawings.

The drawings show.

PREFERRED EMBODIMENT OF THE INVENTION

Figure 1:
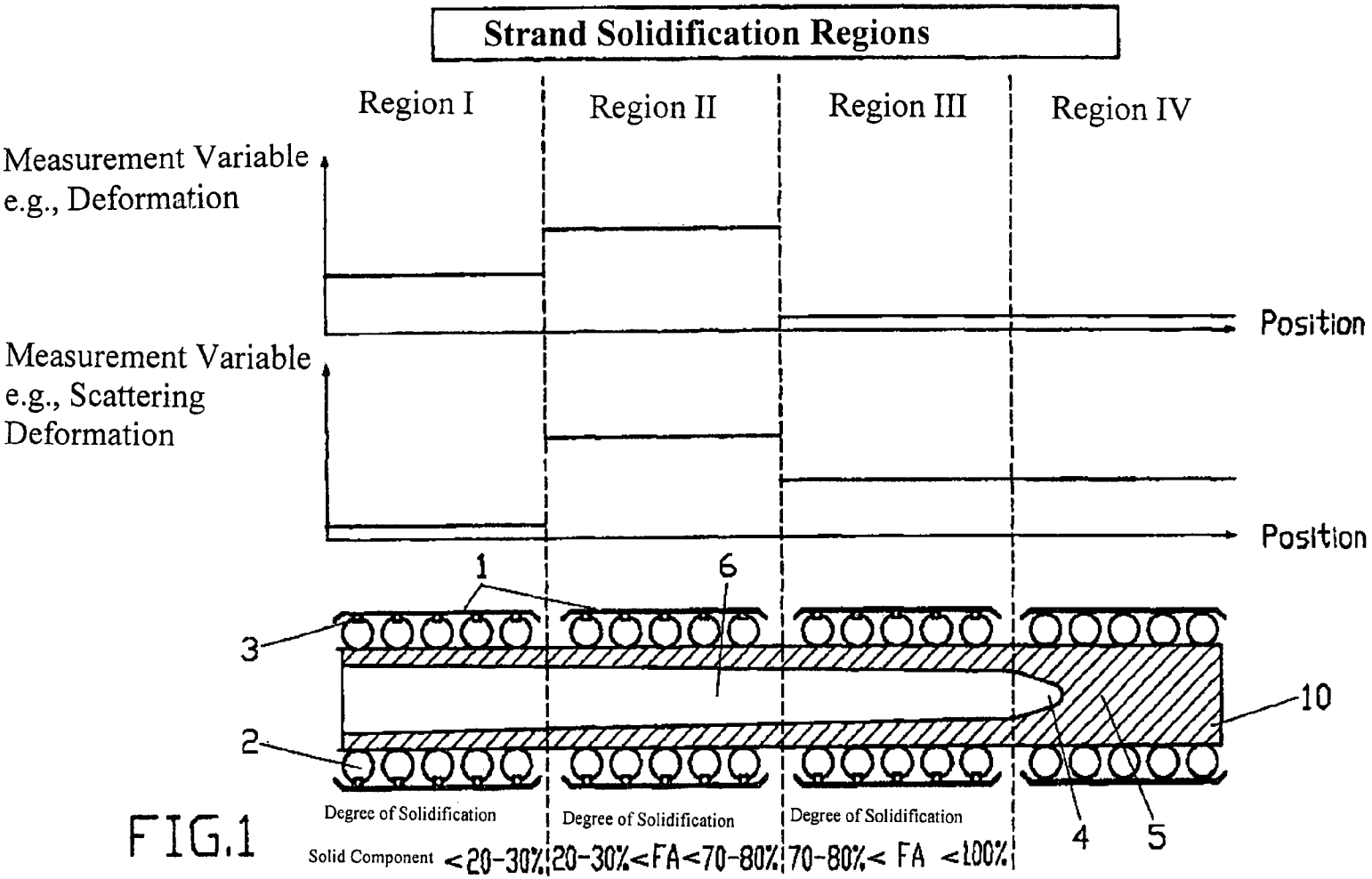
FIG. 1 a schematic view of a cast strand with different solidification states.

FIG. 1 shows a schematic view of a cast strand 10 with different solidification states. The cast strand 10 is guided by a plurality of strand guide elements 1. The strand guide elements 1 have rollers 2 supported by roller supports 3. In the embodiment of FIG. 1, schematically, four segments 1 are shown, each having five roller pairs 2. The cast strand 1 is guided by the rollers. In the first region I, the cast strand 10 is in a solidification state with a degree of solidification of less than 20 to 30%. This means that the liquid or doughy component 6 constitutes from 80 to 70%. In a second region II, the cast strand 10 is in a solidification state with a degree of solidification having a solid portion 5 from 20 to 80%. In a third region III, the cast strand 10 is in a solidification state with a degree of solidification having a solid portion form 70 to 80% but less than 100%. In a fourth region IV, the corresponding solidification state is 100%. Thus, the liquid pool tip as can be seen, is located in the last region IV.

As can be seen, a roller force-representing measurement variable, such as deformation, lies in the first region and in a middle region. The scattering of the measurement variable lies at a low level. In the region II, the measurement variable and its scattering lie at a high level. In the region III and in the region IV, this measurement variable lies at a lower level, but scattering of the measurement variable lies at a middle level.

The region I corresponds to the liquid phase of the strand with a liquid core. Therefore, the liquid phase, which lies partially at a potentially higher level, applies pressure from inside portions of the strand to the strand shell, pressing it from inside out. This ferrostatic should be absorbed by the support forces. The force is, in comparison with the solidification state, high, which leads to that the force-representing measurement valuable lies at a middle level. The soft strand dampens easily, so that the force-representing measurement variable is low. The first region ends, dependent on the steel quality, with a solid component in a range from 20 to 30%.

The second region II is a transition region in which the force level or the level of the force-representing measurement variable lies at a higher level than in the region I. This region has a solidification state from 30% to 70%. The strand 10 still has a liquid core with a solid outer region. In addition to ferrostatic, strand deformation takes place. The damping of the strand is smaller, so that the scattering of the force or the force-representing measurement variable is as in the region I.

The region III represents a quasi solidified region in which the force level or the level of the force-representing measurement variable is small in a direction transverse to the casting direction. In the region III, only portions of the gravity force and the pull-off force operate. The scattering or the standard deviation is high because of small damping of the quasi solidified strand. In this state, melt still exists but which, however, is separated from each other by bridges, so that there is no continuous steel column.

The region IV is the solidification region in which essentially the same forces and variance ratios exist as in the region III.

Figure 2:
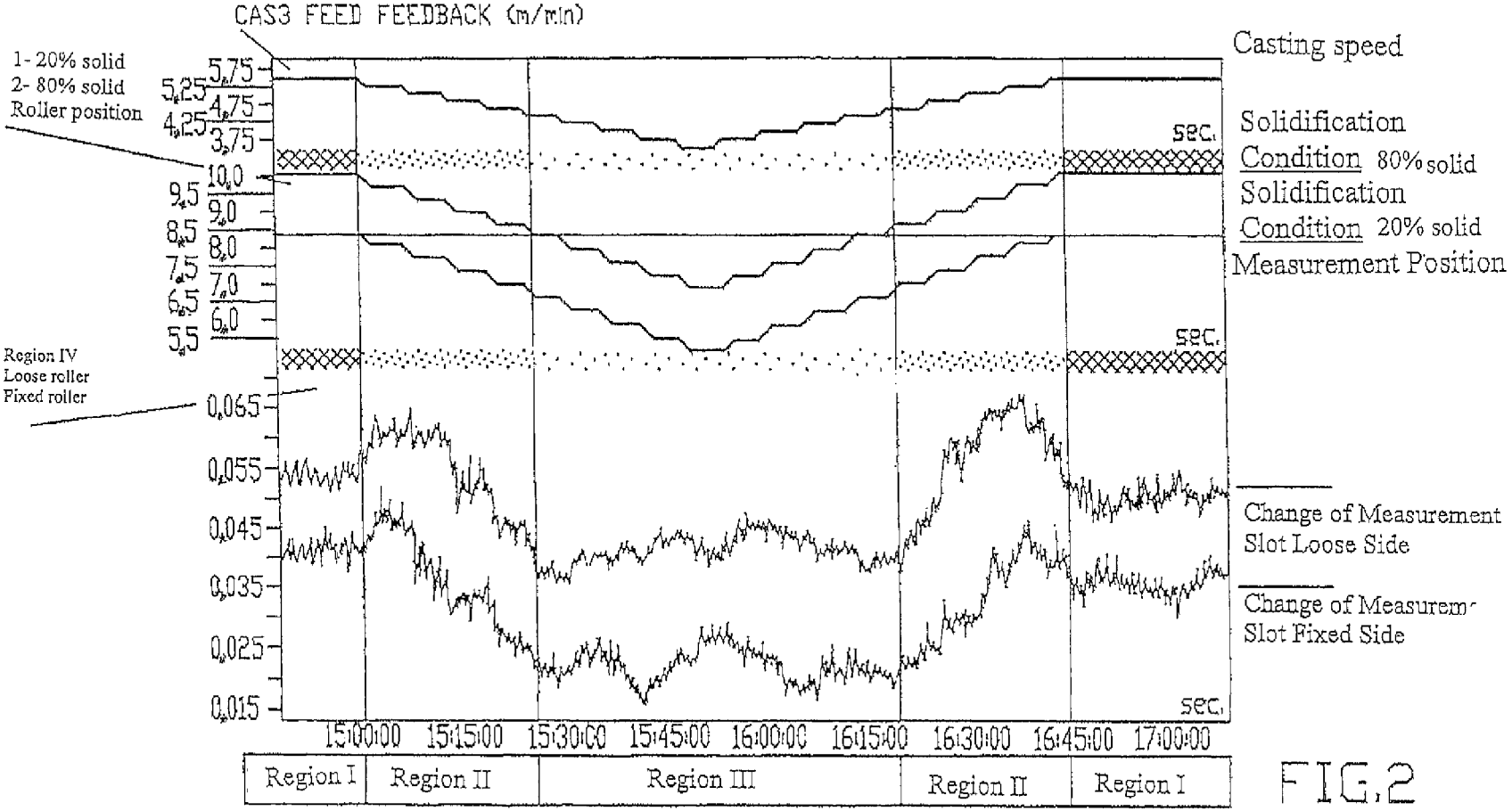
FIG. 2 a diagram.

FIG. 2 shows a diagram in which measurement results, which were obtained at a measurement point on a segment of a continuous casting installation, are represented. In this example, different measurement points are not provided on different segments, but rather measurement points on a single segment are used, and the solidification regions are defined by the measurement points. In the present case, two measurement points are provided on a fixed support and a loose support of a roller support. FIG. 2 shows, in the lower region, with two lower curves, the measurement variables of a force-representing measurement gap. One can recognize a change of the force-representing signal and, thereby can make association with state regions I through III, as explained above. The uppermost curve shows the casting speed as a function of time. One can see that with a changed speed, the position of the liquid pool-tip or the boundary between the state regions is displaced. At high speed, at the measurement point of the state region I, a high liquid component is present. At a reduced speed, at the measurement point of the state region II, a medium liquid component is present. At a low speed, at the measurement point of the state region III, almost no liquid component is present. Thus, it can be seen that with an increased speed, the liquid component at the measurement point increases, and an exchange of the state regions at the measurement point takes place.

Figure 3:
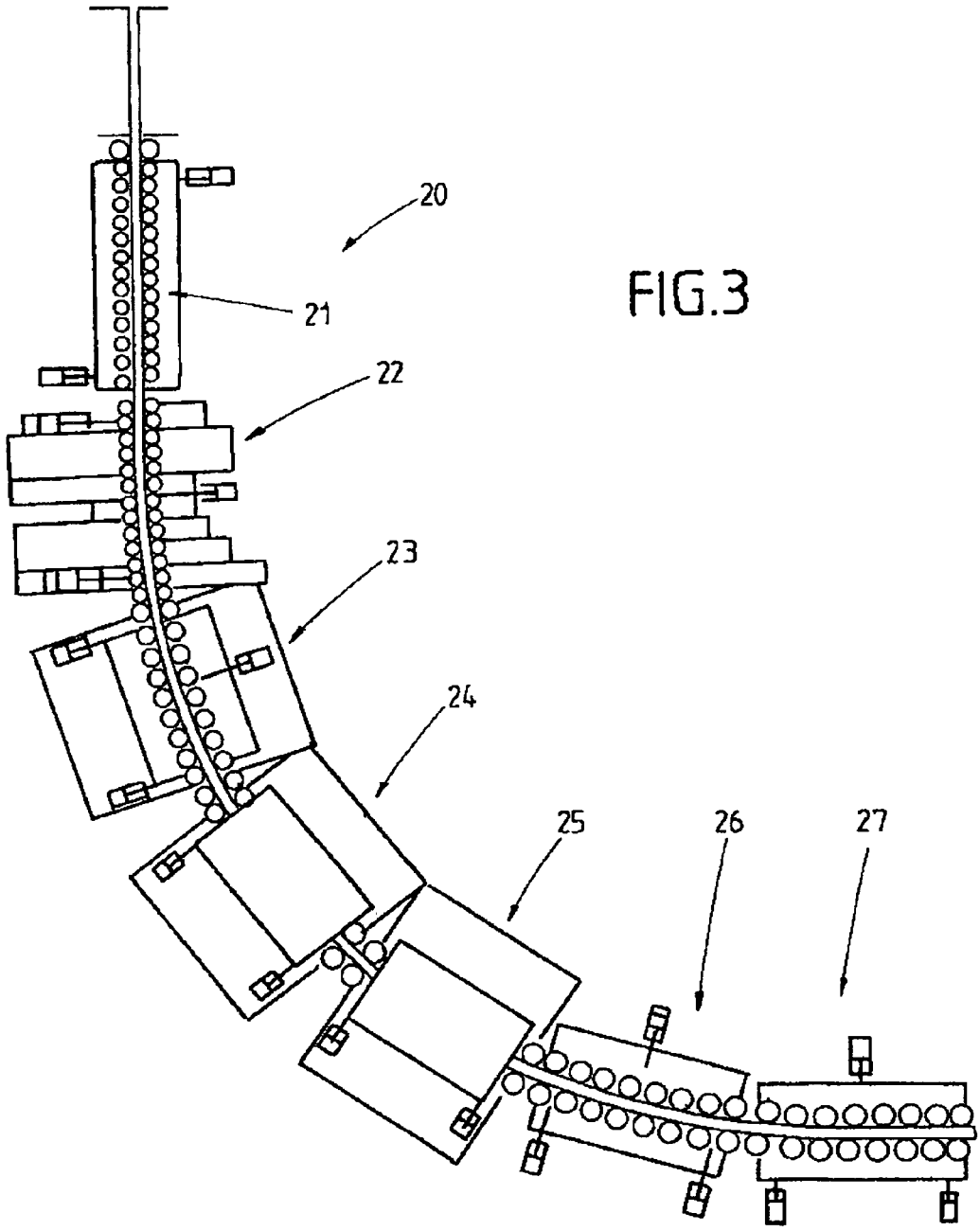
FIG. 3 a schematic view of a continuous casting installation.

FIG. 3 shows schematically a strand casting installation 20 with a cast strand 21 and six segments 22 through 27. Preferably, the liquid pool tip would be in the region of the last or, as the case may be, preceding segment when the casting speed is high. So it can happen that at high casting speeds of more than 6 m/min, e.g., of 7 m/min, the liquid pool tip lies in the last, sixth segment 27. It is particularly advantageous to almost continuously measure the solidification states, and to be able to determine their distribution or the position of the pool tip. As measurement points, e.g., rollers or roller supports are chosen, wherein a measurement point is selected on a loose support and/or fixed support of a roller. By arrangement of different measurement points on different rollers, preferably, in different segments, an advantageous distribution of the solidification states can be determined.

Thus, in a thin slab strand casting installation, with a casting speed of from 6 to 7 m/min, it can, e.g., be advantageously achieved to be able to permanently detect the solidification states. The liquid pool tip then is located, e.g., in the sixth segment 26, i.e., the segment before the last segment.

For detecting solidification states, a support force measurement is carried out. The support force measurement is carried out by an inductive distance measurement, e.g., in a support housing 30, see FIG. 4. The support housing 30 is provided with a horizontal slot 32, beneath the support shell 33, and an inductive distance sensor 34. The change of a slot height of the slot 32 is approximately proportional to the applied force.

The measurement support 30, e.g., is located in the middle bearings of long rollers 2 and 7 of segments 24 and 25 on the fixed side and/or on the loose side. In this way, the distribution of the support force at 2×4 points over the installation length is determined.

Figure 4:
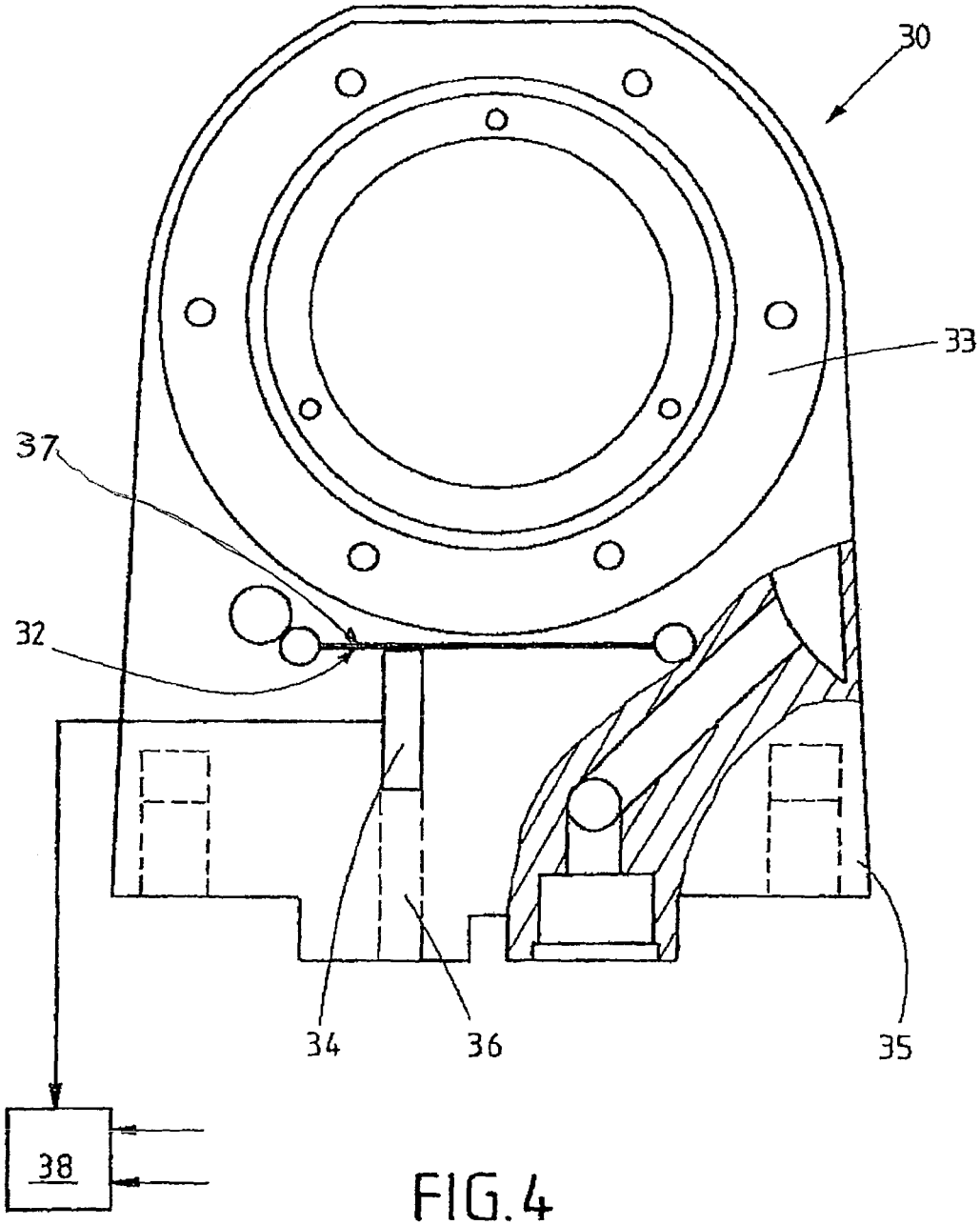
FIG. 4 a schematic view of a support.

As shown in FIG. 4 in the support housing 30 of the separated middle support is slotted beneath the support shell which provides a certain weakening of the support. The position and the geometry of the slot is advantageously so selected that at a maximal load, an advantageously maximal deflection of the slot upper side and no plastic deformation take place. The distance sensor 34 is inserted centrally into the support housing 30 through a bore 36 in the housing base 35 and projects, advantageously into the measuring gap limited by a measuring gap-defining upper edge 37 of the slot 32. The slot 32 is so formed that because of the force action through the strand, a local deformation takes place and which can be detected. With regard to this, reference is made to a prior document DE 10 2006 027 066 the disclosure of which is expressly belongs to the disclosure of the present application. Further, a data processing unit 38 is shown and which receives data from the sensors 34 of the measuring points and determines the solidification states.

REFERENCE NUMERALS

1 Strand guide element
2 Roller
3 Roller support
4 Liquid pool tip
5 Solid component
6 Liquid component
10 Cast strand
20 Continuous casting installation
21 Cast strand
22 Segment
23 Segment
24 Segment
25 Segment
26 Segment
30 Support housing
32 Slot, measurement gap
33 Support shell
34 Sensor
35 Base
36 Bore
37 Measurement gap upper edge
38 Data processing unit

The invention claimed is:

1. A continuous casting installation (20), comprising a strand guide formed of a plurality of casting segments (22, 23, 24, 25, 26, 27), each segment having a plurality of rollers (2), for guiding a strand, supports (3) for supporting the rollers (2), and support housings (30) for receiving the supports (3); and a data processing unit (38) for determining solidification state of the strand, wherein there are provided a plurality of measurement points for determination of deformation forces acting on respective middle supports for respective rollers of respective segments, wherein each measurement point is provided on a support housing of a respective middle support between the respective middle support and a frame of a respective measurement segment, and wherein the data processing unit determines the solidification state of the strand based on distribution of deformation of the middle supports under deformation forces acting thereon by an analytical statistical evaluation method for determining level differences of measurement variables.

2. A continuous casting installation according to claim 1, wherein the measurement point is provided on at least one of the fixed side and loose side of the respective segment.

3. A continuous casting installation according to claim 1, wherein a measurement variable is evaluated with the data processing unit (38) by fast Fourier analysis or another statistic evaluation method and, thereby, instrumental influences on the measurement variable are determined.

4. A continuous casting installation according to claim 1, further comprising sensor means located at a measurement point for determining a deformation force acting on the respective support and for communicating a measured variable to the data processing unit.

5. A method of determining solidification states of a cast strand (6) within a strand guide of a continuous casting installation (20), wherein the strand guide has a plurality of casting segments (22, 23, 24, 25, 26, 27) with rollers (2), comprising the following steps:

determining forces acting on several middle rollers (2) at support housings (30) of respective middle roller supports between the respective middle supports and segment frames of respective segments, and determining solidification states of the cast strand based on distribution of deformation of the middle supports under deformation forces acting thereon by an analytical statistical evaluation method for determining level differences of measurement variables.

6. A method according to claim 5, wherein determination of the solidification state is carried out by associating a solidification state with characteristic measurement variables.

7. A method according to claim 6, wherein the characteristic measurement variables are support forces or support deformations.

8. A method according to claim 5, wherein the determination of the solidification state is carried out by associating the solidification state with distribution of characteristic measurement variables.

9. A method according to claim 8, wherein the distribution of the measurement variables is distribution of support deformation.

10. A method according to claim 5, wherein the measurement variable is evaluated by the data processing unit (38) by fast Fourier analysis or another statistic valuation method and, whereby instrumental influences on the measurement variable are determined.

* * * * *